US006092320A

United States Patent [19]

Bringuet

[11] Patent Number: 6,092,320

[45] Date of Patent: Jul. 25, 2000

[54] RAIL SIGN DEVICE

[76] Inventor: Dennis L. Bringuet, 3000 Crown Point, Springfield, Ill. 62704

[21] Appl. No.: 09/002,222

[22] Filed: Dec. 31, 1997

[51] Int. Cl.[7] ..... G09F 7/02

[52] U.S. Cl. ..... 40/618; 40/661.03

[58] Field of Search ..... 40/606, 611, 618, 40/621, 661.03

[56] References Cited

U.S. PATENT DOCUMENTS 2,319,910 5/1943 Adler ..... 40/618

5,065,537 11/1991 Bailey ..... 40/618

5,419,066 5/1995 Harnois et al. ..... 40/661.03

*Primary Examiner*—Cassandra Davis

*Attorney, Agent, or Firm*—Cherskov and Flaynik

[57] ABSTRACT

A rail sign device 10 with removable inserts 28 assembled to form a predetermined display therein, is installed upon an elevated rail sign 22 by a person at ground level using only a lifting tool 20. The rail sign device 10 is removably secured to adjacent, horizontally extending rails 38 and 56 via opposing rail channels 32 and 50 integrally formed to the device 10. Once installed, a transparent display portion 16 of the device 10 allows persons at ground level to view the display.

12 Claims, 6 Drawing Sheets

RAIL SIGN DEVICE

BACKGROUND OF THE INVENTION

1. Field of the Invention

The present invention relates generally to rail sign displays and, more particularly, to devices that removably receive display inserts at ground elevation, the device then being secured to an elevated rail sign by one person at ground elevation.

2. Background of the Prior Art

Rail signs are utilized in numerous displays. Businesses use signs with marquis for advertising either products or services. Small business and individual use mobil rail signs that can be hauled to a particular location and left for an indefinite period of time. The advantage of rail signs is that the inserts, the letters or numbers that form the display, are easily arranged and altered. Also, the signs generally are resistant to winds and the elements; although strong wind gusts can force the inserts out of the rails and onto the ground.

Installing the inserts on a rail sign at ground elevation is a relatively simple task. A person need only slide the inserts into position by hand. However, when working with an elevated rail sign, one must use a ladder and position the inserts by hand, or when standing at ground level, one would use a suction tool with an extension handle so that a person could reach the rails with the tool and slide the inserts in one at a time. This can be a time consuming job especially when a display calls for a large quantity of inserts. Further, if the display is changed often, excessive man hours are spent by placing one insert on the suction tool, reaching up to slide the insert between adjacent rails, bringing the suction end back to ground level, placing another insert on the suction end, then repeating the entire cycle. Should one accidentally install an insert at the wrong position, an entire line of inserts may have to be removed to correct the one problem input, then the entire line would once again be slid into position by a person using the suction tool from ground level or by using a ladder and sliding the inserts into position by hand.

The advantage of using the suction tool is that a person is safely at ground level when manipulating the inserts, but the display assembly may take longer to complete. However, when working with a relatively large elevated rail sign, a person using a ladder may have to move the ladder several times to position all the inserts to complete the display.

Although many variations of rail signs are available, (see U.S. Pat. Nos. 3,470,640; 3,883,973; and 3,470,640), none provide a device for a person to safely and quickly assemble a display at ground level, then lift the device with the assembled display thereon to an elevated rail sign. Whereupon the device is easily secured to the rail sign.

SUMMARY OF THE INVENTION

It is an object of the present invention to provide a device for an individual assembling a display on a rail sign to overcome many of the disadvantages of the prior art.

A principle object of the present invention is to provide a device that allows an individual to assemble a display at ground level, then raise the display to an elevated rail sign. A feature of the device is that it has opposing channels for removably receiving number or letter inserts to assemble a display. An advantage of the device is that the display is quickly and safely assembled at grade level.

Still a further object of the present invention is to enable easy raising of the device to an elevated rail sign. A feature of the device is a recess that removably receives a lifting pole. An advantage of the device is that it allows a lifting pole to be removable received therefrom while the individual lifting the device remains at ground level.

Yet another object of the present invention is to allow the device to be easily attached to and removed from an elevated rail sign by an individual at ground level. A feature of the device is oppositely facing channels dimensioned to receive corresponding rails of an elevated rail sign. An advantage of the device is that it can "hook" onto the rails of a rail sign without having to be "slid" between adjacent rails. Another advantage of the device is that it can be sized to connect to any portion of an elevated rail sign by an individual at ground level.

Briefly, the invention provides a rail sign device that allows a display to be assembled at ground elevation and attached to an elevated rail sign comprising means for assembly multiple display inserts in said rail sign device; means for securing said rail sign device to at least two rails of a rail sign; means for elevating said rail sign device to said elevated rail sign by a person at ground elevation; and means for installing said rail sign device upon said elevated rail sign by a person at ground elevation.

BRIEF DESCRIPTION OF THE DRAWINGS

The foregoing invention and its advantages may be readily appreciated from the following detailed description of the preferred embodiment, when read in conjunction with the accompanying drawings in which.

DETAILED DESCRIPTION OF THE PREFERRED EMBODIMENT

Figure 1:
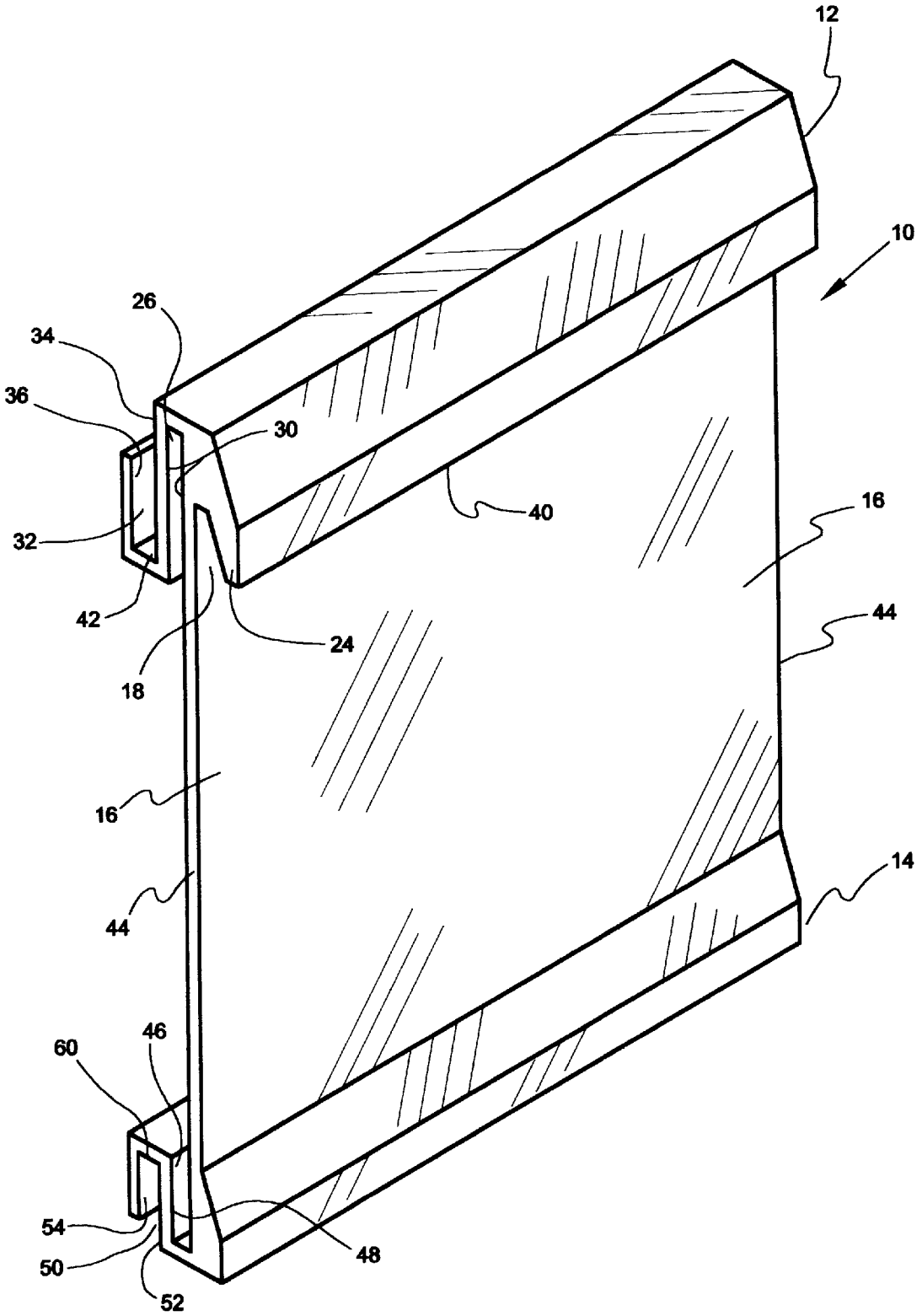
FIG. 1 is a front perspective view of the present invention.
Figure 2:
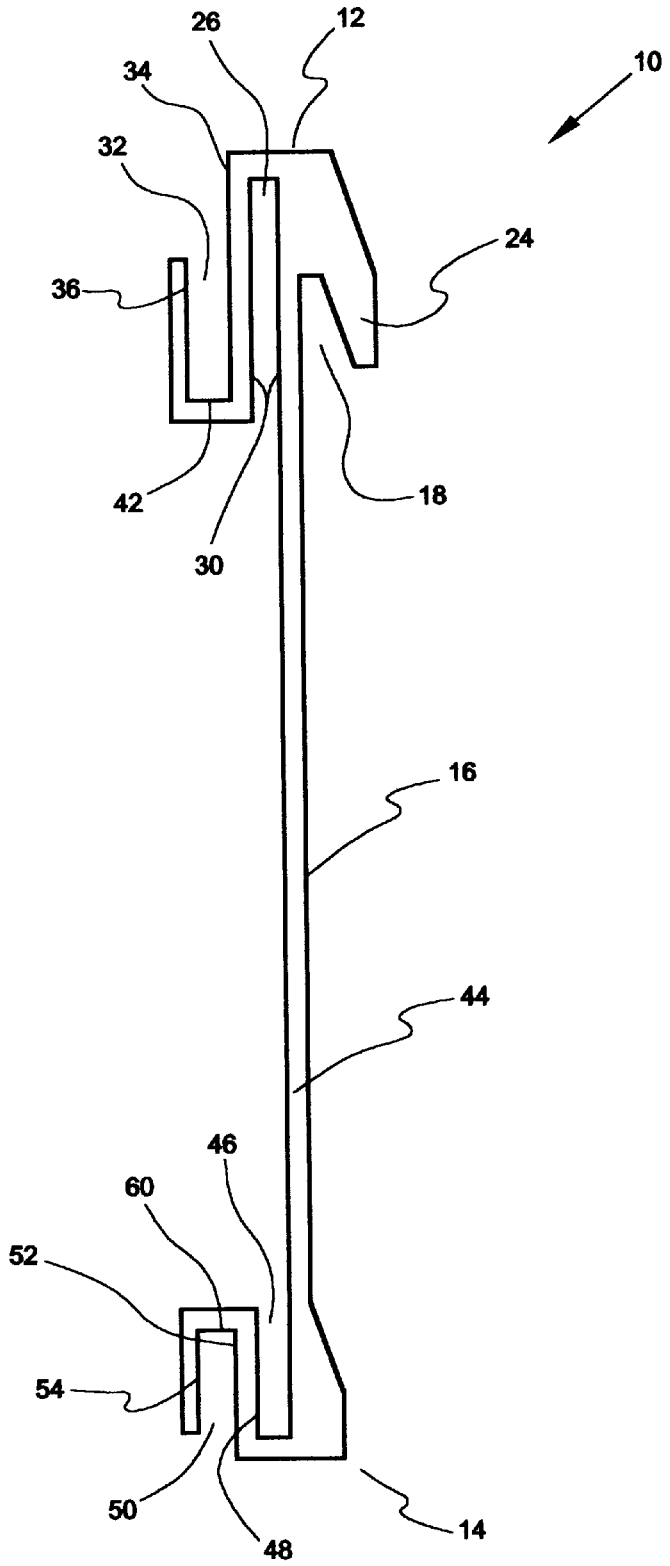
FIG. 2 is a side elevation view of the rail sign device of FIG. 1.
Figure 3:
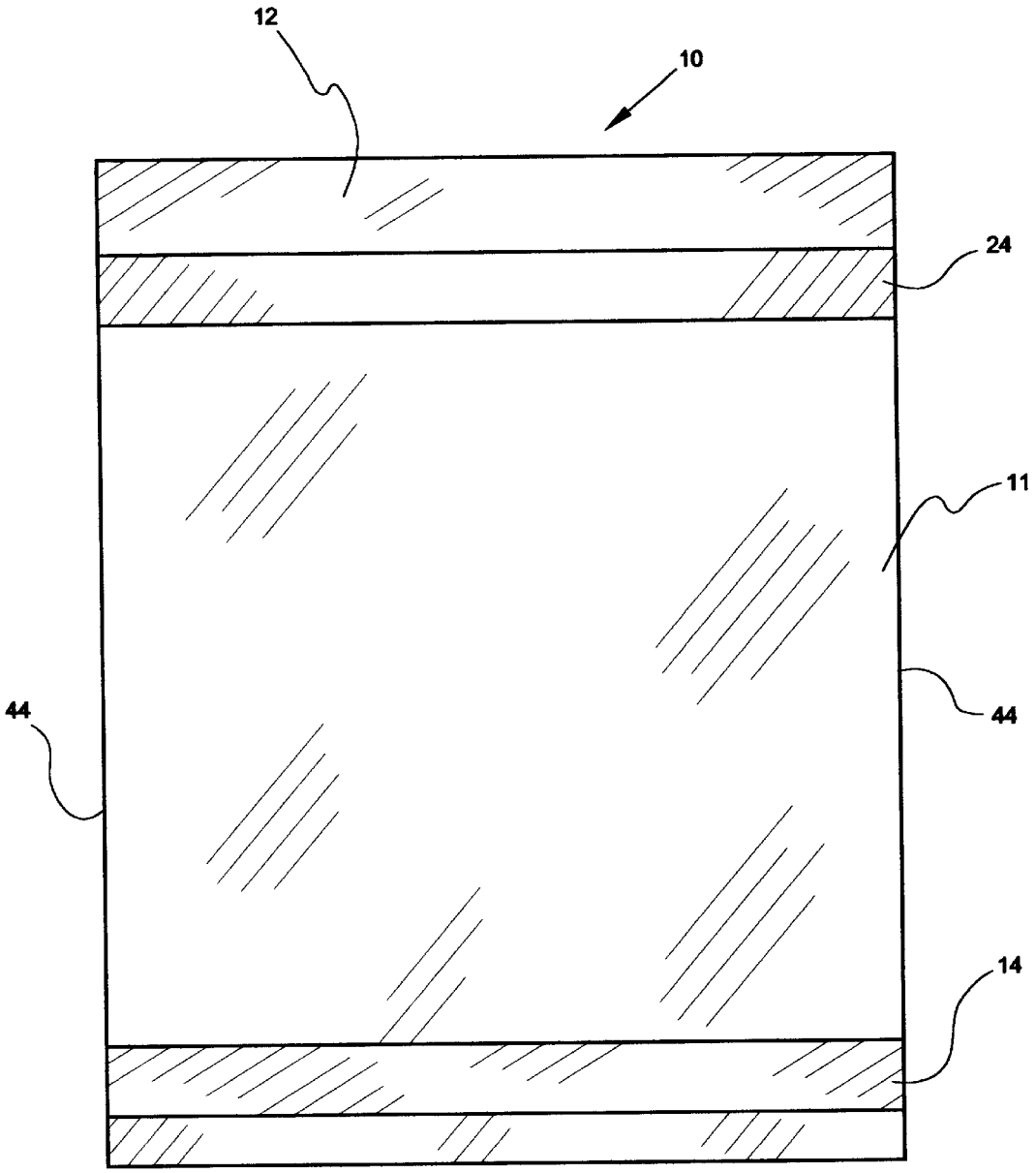
FIG. 3 is a front elevation view of the rail sign device of FIG. 1.

Referring now to the figures and in particular to FIG. 1–3, perspective, side and front elevation views of a rail sign device in accordance with the present invention is denoted by numeral 10. The rail sign device 10 is a single piece of extruded clear polycarbonate with ultraviolet inhibitors to prevent fading due to exposure to sunlight. Although a plastic unibody construction is the preferred embodiment, the device 10 may be constructed of a myriad of materials including but not limited to wood, stainless steel and aluminum. Further, the device may be assembled from several parts depending on the material of construction and the size of the device 10. The device 10 includes an upper portion 12, lower portion 14 and display portion 16.

Figure 4:
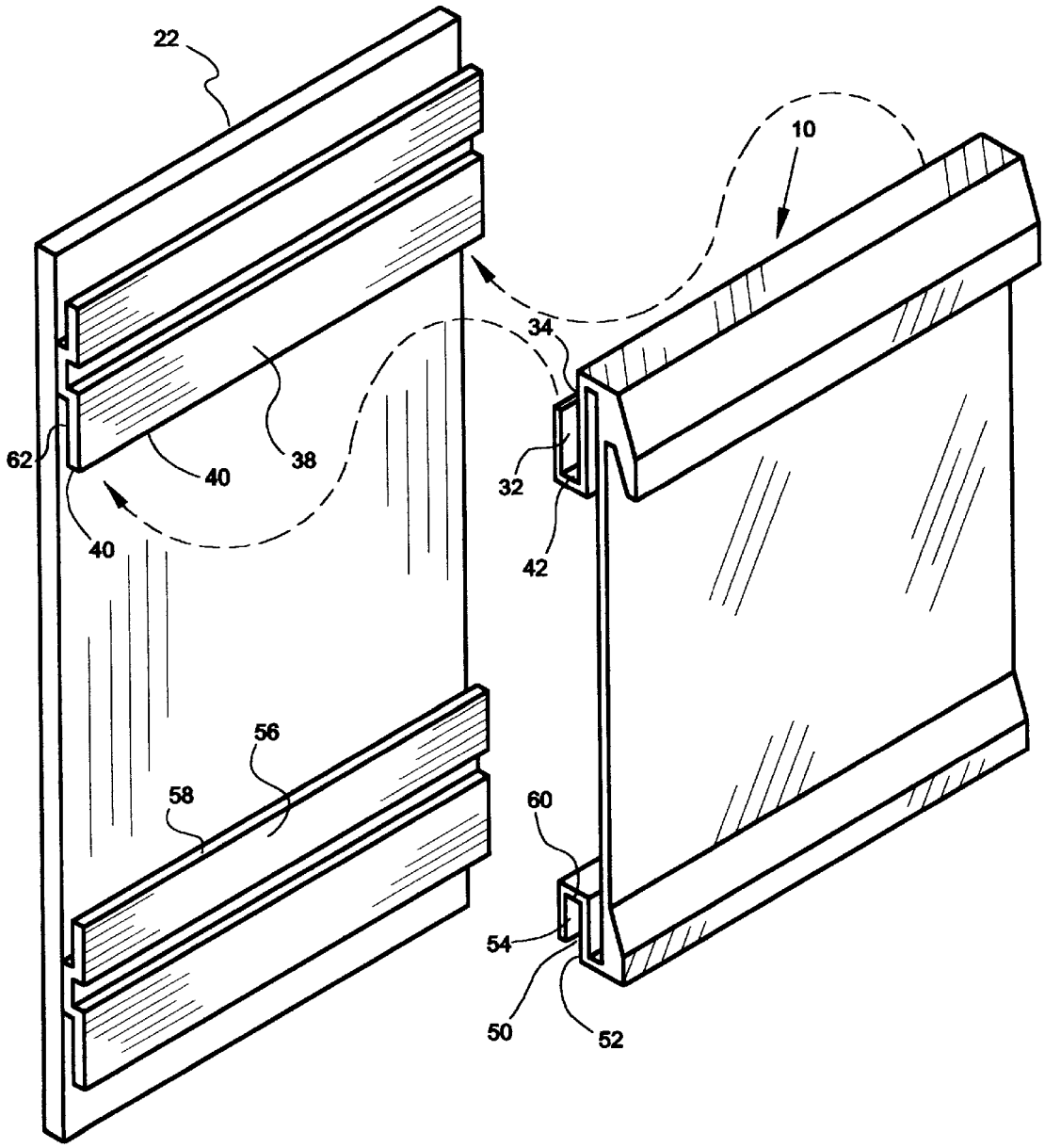
FIG. 4 is a front perspective view of a rail sign device depicting how the device inserts into the rails of a rail sign also shown with a front perspective view.
Figure 6:
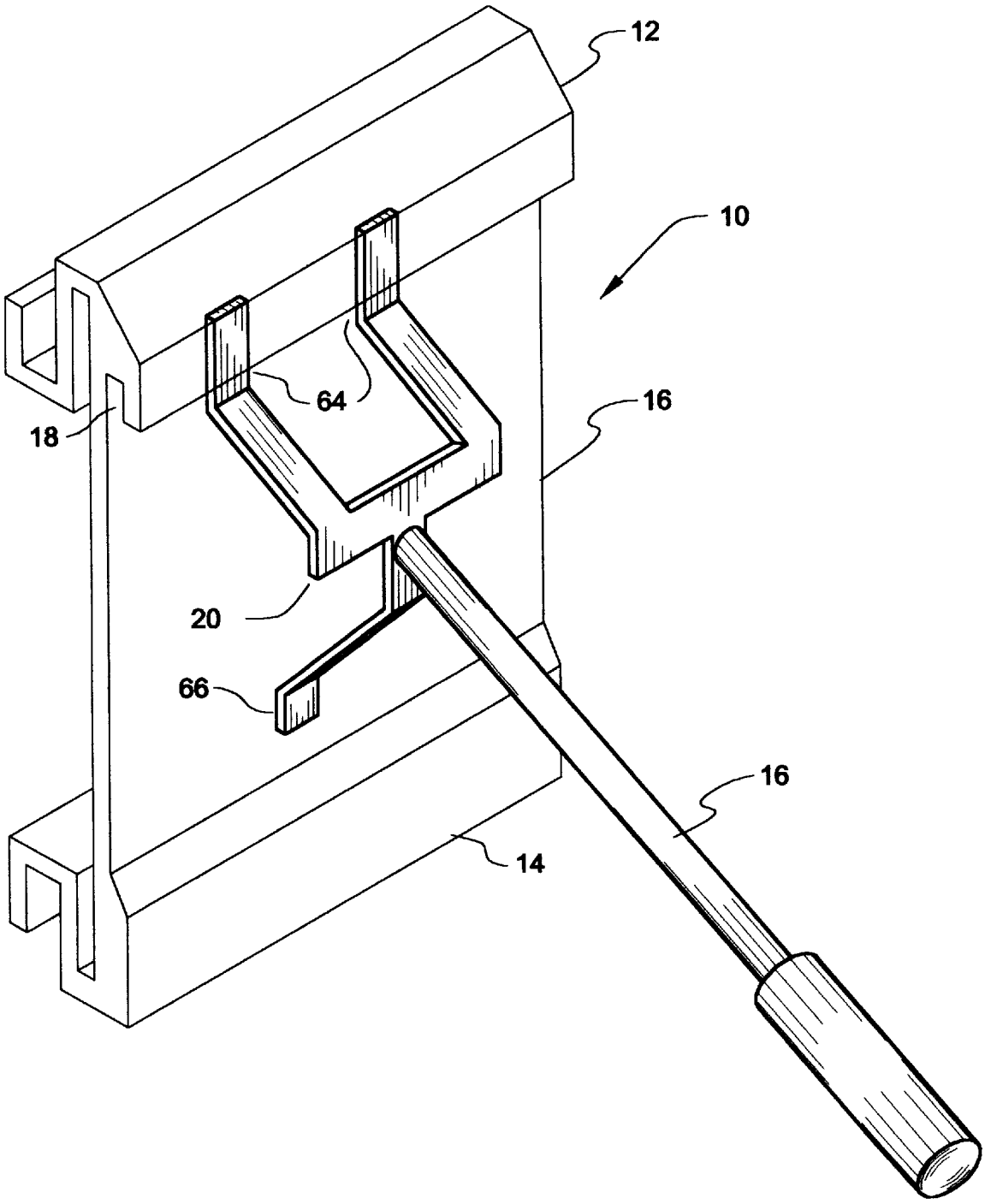
FIG. 6 is a front perspective of the present invention with a lifting pole engaging a lifting recess.

The upper portion 12 includes a lifting recess 18 utilized to removably receive a lifting tool 20 (see FIG. 6) ultimately allows the device 10 to be lifted by a person at ground level to an elevated rail sign 22 (see FIG. 4). The lifting recess is relatively rectangular shaped when taking a side view of the device 10 (see FIG. 2), extends longitudinally through the entire upper portion 12, and of sufficient depth to form an extension or "hook" 24 capable of capturing the lifting tool 20 that elevates the device 10.

The upper portion 12 further includes an upper letter channel 26 that extends downward and is rectangular in configuration when taking a side view of the device 10 and like the lifting recess 18, extends longitudinally through the entire upper portion 12. The upper letter channel 26 side view configuration depicts the channel 26 having a relatively small lateral dimension as compared to the larger longitudinal dimension. The lateral dimension is sized to allow a display insert 28 (see FIG. 5), a piece of clear plastic with letters or numbers painted thereon, to slide through the letter channel 26 relatively unrestricted thereby allowing the inserts 28 to be positioned to form a predetermined display. The longitudinal dimension is sized to provide sufficient surface area for two walls 30 contacting the inserts 28 to prevent the inserts 28 from being blown through the channel 26 and upon the ground.

The upper portion 12 also includes an upper rail channel 32 that extends upward and like the lifting recess 18 and upper letter channel 26, extends longitudinally across the entire upper portion 12. The upper rail channel 32 is relatively rectangular when taking a side view of the upper portion 12, except that a first side wall 34 forming the rail channel 32 extends substantially higher than a second side wall 36. The first and second side walls 34 and 36 work in conjunction with an upper rail 38 (see FIG. 4) of a rail sign 22. When the device 10 is elevated such that the upper portion 12 of the device 10 is positioned proximally to the upper rail 38 of the rail sign 22, the second wall 36 is allowed to slide under the upper rail 38 until the first wall 34 makes physical contact with the rail 38, whereupon the upper portion 12 is elevated until a lower wall 40 of the rail 38 makes physical contact with a lower wall 42 of the upper rail channel 32.

The display portion 16 of the device 10 has substantially a rectangular configuration when taking a front elevation view of the device with side walls 44 of sufficient lateral dimension to provide the required thickness and corresponding strength for the device to prevent cracking or other fatigue failures due to wind, rain or other weather conditions. The side walls 44 have a longitudinal dimension sufficient to position the upper and lower portions 12 and 14 of the device 10 adjacent to preselected rails of the rail sign 22.

The lower portion 16 of the device 10 includes a lower letter channel 46 that extends upward and is rectangular in configuration when taking a side view of the device 10 and like the upper letter channel 26, extends longitudinally across the entire lower portion 16. The lower letter channel 46 side view configuration depicts the channel 46 having the same relatively small lateral dimension as the upper channel 26; however, the longitudinal dimension of the lower channel 46, although substantially larger than the lateral dimension, is relatively smaller than the corresponding longitudinal dimension of the upper letter channel 26.

The longitudinal axes of the upper and lower letter channel 26 and 46 are aligned, and the equal lateral dimensions of the channels 26 and 46 together with the predetermined longitudinal dimension of the display portion side walls 44, provide the means to removably receive display inserts 28 such that the inserts are relatively easily slid through the aligned channels 26 and 46.

The lower portion 14 further includes a lower rail channel 50 that extends downward and like the lower letter channel 46, extends longitudinally across the entire lower portion 14. The lower rail channel 50 is relatively rectangular when taking a side view of the lower portion 14, except that a first side wall 52 forming the rail channel 50 extends substantially lower than a second side wall 54. The first and second side walls 52 and 54 work in conjunction with a lower rail 56 (see FIG. 4) of a rail sign 22. When the device 10 is elevated such that the upper portion 12 of the device 10 is positioned proximally to the upper rail 38 of the rail sign 22, and the upper portion 12 is elevated until the lower wall 40 of the rail 38 makes physical contact with the lower wall 42 of the upper rail 32; the lower portion 14 is positioned such that the lower rail channel 50 is directly above the lower rail 56 whereupon the lower portion 14 is lowered until an upper wall 58 of the lower rail 56 makes physical contact with an upper wall 60 of the lower rail channel 50 (see FIG. 5).

Figure 5:
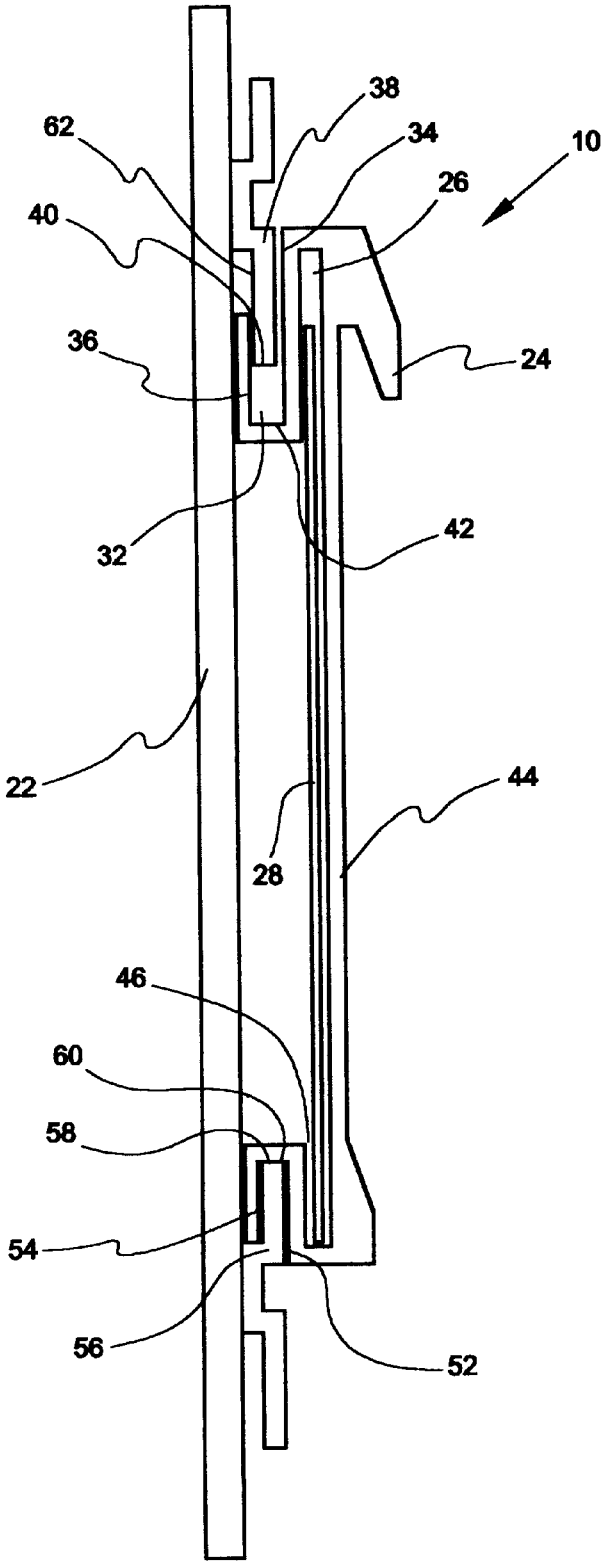
FIG. 5 is a side elevation view of a rail sign device attached to a rail sign in accordance with the present invention.

The technique of installing the device 10 upon a rail sign 22 with the two structures positioned adjacently as depicted in FIG. 4, is accomplished due to the longitudinal dimension of the first side wall 34 of the upper rail channel 32 being relatively longer than the longitudinal dimension of the first side wall 52 of the lower rail channel 50. Referring to FIG. 5, the device 10 is depicted secured to the rail sign 22 via upper and lower rail channel 32 and 50. One can readily observe that the longitudinal dimensions of the first and second walls 34 and 36 of the upper channel 32 allow the device 10 to slide upwards far enough to enable the lower channel 50 to clear the lower rail 56 and "swing" perpendicularly toward or from the rail sign 22. Further, when the lower channel 50 is positioned directly above the lower rail 56, the device 10 may be lowered until physical contact between the lower channel 50 and the lower rail 56 is achieved; however, the upper channel 32 is still able to main a secured position with the upper rail 38 due to the second wall 36 maintaining physical contact with an inner wall 62 of the upper rail 38.

In operation, an elevated rail sign 22 having a vertical, planar surface with multiple horizontally positioned rails extending substantially across the entire sign 22, is selected to receive a rail sign device 10. The device 10 is extruded a length such that upper, lower, and display portions 12, 14 and 16 of the device 10 have longitudinal dimensions substantially equal to the length of the rails 38 and 56 of the rail sign 22. Also, the device 10 must extend a width such that the longitudinal dimension of the side walls 44 of the display portion 16 positions the upper and lower portions 12 and 14 of the device 10 proximally with preselected upper and lower rails 38 and 56 of the rail sign 22. Finally, the upper and lower portions 12 and 14 must be extruded such that corresponding upper and lower rail channels 32 and 50 are configured to receive upper and lower rails 38 and 56 of the rail sign 22 from an adjacent, parallel position thereby securing the device 10 to the rail sign 22.

The extended device 10 is then set proximally to the rail sign 22 at ground level. A preset display comprised of multiple inserts 28 is assembled in the device 10 by sliding the inserts 28 in a prearranged format serially via the aligned upper and lower letter channels 26 and 46. The distance separating the upper and lower rail channels 32 and 50 is ample to allow a persons hand therebetween to forcibly slide the inserts 28 through the letter channels 26 and 46. The transparent display portion 16 allows persons at ground level to view the display.

A lifting tool 20 such as a periscoping type pole having a tripod configuration that contacts the device 10, is positioned such that two elements 64 are inserted into the lifting recess 18 and a third element 66 butts against a lower area of the display portion 16. A person then lifts the device 20 proximally to the rail sign 22. The person then slides the upper rail channel 32 under the upper rail 38 of the rail sign 22 until the lower wall 42 contacts the upper rail 38. The person then swings the lower rail channel 50 above the lower rail 56 via the third element of the lifting tool 20. The person then lowers the device until the upper wall 60 of the lower rail channel 50 physically contacts the upper wall 58 of the lower rail 56 of the rail sign 22 thereby securing the device 10 to the rail sign 22, whereupon the lifting tool 20 is lowered until the two elements 64 are removed from the lifting recess 18 allowing the device 10 to be independently supported by and secured to the rail sign 22. Finally, although the installation of the device 10 uses adjacent rails on the rail sign for securing the device, one could easily design the device 10 to use any two horizontal rails on an existing elevated rail sign 22. The only limiting feature when selecting two rails, is that one rail must extend downward and the second rail must extend upward.

The foregoing description is for purposes of illustration only and is not intended to limit the scope of protection accorded this invention. The scope of protection is to be measured by the following claims, which should be interpreted as broadly as the inventive contribution permits.

What is claimed is:

1. A display device having removable display inserts therein, said display device being adapted to be removably received upon a rail sign, said display device comprising:

a lifting recess;

means for removably receiving said display inserts in said display device;

means for lifting adapted to engage said lifting recess for lifting said display device from a first elevation to said rail sign positioned at a second elevation; and means for installing said display device upon said rail sign at said second elevated position without laterally sliding said display device relative to said rail sign.

2. The display device of claim 1 wherein said securing means includes two opposing channels orientated to receive corresponding rails attached to said rail sign.

3. The display device of claim 1 wherein said receiving means includes two channels positioned to receive opposing portions of said removable display inserts.

4. A display device having removable display inserts therein, said display device being adapted to be removably received upon a rail sign, said display device comprising:

a lifting recess;

means for dimensioning opposing channels of said display device such that a first portion of an upper channel communicates with a first portion of a first rail of said rail sign while a corresponding first portion of a lower channel is positioned proximally to a corresponding first portion of a second rail of said rail sign, said first portion of said lower channel being lowered into communication with said first portion of said second rail of said rail sign with a second portion of said upper channel remaining in communication with a second portion of said first rail thereby securing said display device to said rail sign;

means for positioning said display device upon adjacent rails on said rail sign without laterally sliding said display device relative to said rail sign;

means for removably receiving said display inserts in said display device; and means for lifting adapted to engage said lifting recess for enabling said display device to be lifted from a first elevation to said rail sign positioned at a second elevation.

5. A method for assembling a display device at a first elevation for detachable installation upon a rail sign at a second elevation comprising the steps of:

providing a lifting recess in said display device;

removably receiving display inserts within said display device at said first elevation;

providing lifting means adapted to engage said lifting recess for lifting said display device from said first elevation to said rail sign at said second elevation; and installing said display device upon said rail sign by a person at said first elevation without laterally sliding said display device relative to said rail sign.

6. The method of claim 5 wherein the step of securing said display includes the step of providing two opposing channels orientated to receive corresponding rails attached to said rail sign.

7. The method of claim 5 wherein the step of removably receiving display inserts includes the step of providing two facing channels positioned to receive opposing portions of said display inserts.

8. A method for assembling a display device at a first elevation for detachable installation upon a rail sign at a second elevation comprising the steps of:

dimensioning opposing channels of said display device such that a first portion of an upper channel communicates with a first portion of a first rail of said rail sign while a corresponding first portion of a lower channel is positioned proximally to a corresponding first portion of a second rail of said rail sign, said first portion of said lower channel being lowered into communication with said first portion of said second rail of said rail sign with a second portion of said upper channel remaining in communication with a second portion of said first rail thereby securing said display device to said rail sign;

providing a lifting recess;

removably receiving display inserts within said display device at said first elevation;

providing lifting means adapted to engage said lifting recess for lifting said display device from said first elevation to said rail sign at said second elevation; and positioning said display device upon said rails of said rail sign without laterally sliding said display device relative to said rail sign.

9. A rail sign device that allows a display to be assembled at ground elevation and attached to an elevated rail sign comprising:

a lifting recess;

means for assembling multiple display inserts within said rail sign device; means for lifting adapted to engage said lifting recess for lifting said rail sign device from ground elevation to said elevated rail sign; and means for installing said rail sign device upon said elevated sign without laterally sliding said display device relative to said rail sign.

10. The rail sign device of claim 9 wherein said assembly means include two channels orientated to receive upper and lower portions of said display inserts.

11. The rail sign device of claim 9 wherein said securing means includes two opposing channels orientated to receive corresponding rails attached to said rail sign.

12. A rail sign device that allows a display to be assembled at ground elevation and attached to an elevated rail sign comprising:

means for dimensioning opposing channels of said rail sign device such that a first portion of an upper channel communicates with a first portion of a first rail of said rail sign while a corresponding first portion of a lower channel is positioned proximally to a corresponding first portion of a second rail of said rail sign, said first portion of said lower channel being lowered into communication with said first portion of said second rail of said rail sign with a second portion of said upper channel remaining in communication with a second portion of said first rail thereby securing said rail sign device to said rail sign;

a lifting recess;

means for assembling multiple display inserts in said rail sign device;

means for lifting adapted to engage said lifting recess for elevating said rail sign device to said elevated rail sign by a person at ground elevation; and means for positioning said rail sign device upon said rails of said elevated rail sign without laterally sliding said rail sign device relative to said rail sign.

* * * * *